US005224634A

United States Patent [19]

Graham

[11] Patent Number: 5,224,634

[45] Date of Patent: Jul. 6, 1993

[54] DECANTER VESSEL AND POURING SPOUT

[75] Inventor: William Graham, Kingman, Ariz.

[73] Assignee: Wilbur Curtis Company, Inc., Los Angeles, Calif.

[21] Appl. No.: 703,187

[22] Filed: May 20, 1991

[51] Int. Cl.[5] ..... A47G 19/14

[52] U.S. Cl. ..... 222/475.1; 215/100 A; 222/566; 222/570

[58] Field of Search ..... 222/475.1, 465.1, 475, 222/570, 566, 568, 542; 294/31.2; 215/100 A; 285/423, 921

[56] References Cited

U.S. PATENT DOCUMENTS

| | | | |
|---|---|---|---|
| 1,820,406 | 8/1931 | Thompson | 222/570 |
| 2,982,451 | 5/1961 | Eisendrath | 222/475.1 |
| 3,154,227 | 10/1964 | Anderson | 222/542 |
| 3,216,610 | 11/1965 | Klygis | 222/570 X |
| 3,330,449 | 7/1967 | Bloomfield | 222/475.1 X |
| 3,400,865 | 9/1968 | Hester | 222/475.1 |
| 3,491,924 | 1/1970 | Bloomfield | 222/475.1 |
| 3,615,045 | 10/1971 | Fiorini | 222/475.1 |
| 3,632,025 | 1/1972 | Bloomfield | 222/472 |
| 3,800,988 | 4/1974 | Karlen | 222/475.1 |
| 4,090,648 | 5/1978 | Roberts | 222/475.1 |
| 4,227,629 | 10/1980 | Froyman | 222/566 |
| 4,344,549 | 8/1982 | Paradis | 222/475.1 |
| 4,568,005 | 2/1986 | Jalovec | 222/570 X |
| 4,702,395 | 10/1987 | Nitsch | 222/567 X |
| 4,838,463 | 6/1989 | Roberts | 222/465.1 |
| 4,930,687 | 6/1990 | Brindöpke et al. | 222/475.1 |

*Primary Examiner*—Kevin P. Shaver

*Attorney, Agent, or Firm*—Fulwider, Patton, Lee & Utecht

[57] ABSTRACT

A decanter vessel including a rigid flask formed with an upwardly projecting neck terminating in a circular edge. Received over such neck is the annular skirt of a pouring spout unit. Such skirt being formed with a frusto conically shaped interior and including on its inner wall a set of inwardly face and upwardly angled ratchet teeth spaced from the neck to form an annular cavity. Received in such annular cavity is a locking ring, such ring having ratchet teeth formed in its exterior for engagement with the first mentioned set of ratchet teeth. The ring is contractible radially inwardly such that, when pressed upwardly into the cavity will cause the wall of the skirt to press such ring radially inwardly against the surface of the neck to thereby entrap the neck within the pour spout unit.

13 Claims, 2 Drawing Sheets

DECANTER VESSEL AND POURING SPOUT

BACKGROUND OF THE INVENTION

1. Field of the Invention

The present invention relates to a decanter of the type generally utilized for storage brewed coffee for dispensing thereof into individual beverage cups.

2. Description of the Prior Art

Glass or glass-like decanters have long been utilized for dispensing brewed coffee since the glass or glass-like receptacles are generally highly resistant to attack by the coffee and avoid detracting from the taste thereof. Typically, such glass decanters are formed with an integral neck portion upon which is mounted a pouring spout, such pouring spout typically incorporating a unitary handle. The pouring spout assembly have, in the past, typically incorporated a split annular band for embracing the neck and contractible about a soft pliable gasket intended to, when assembled, seal between the band and neck portion of the receptacle. A conventional decanter of this type is shown in U.S. Pat. No. 3,632.025 to Bloomfield.

While having enjoyed some commercial success, devices of this type have several inherent drawbacks. For instance, they require a relatively large number of parts thus adding to the cost of manufacture and assembly. Further, because the seal between the band and neck portion of the receptacle is provided by a flexible gasket, a defective gasket or improper assembly of the vessel can result in loosening of the neck band and leakage of liquid between the neck band and neck of the decanter. Furthermore, due to the necessity of a separate flexible gasket and the decanter vessel, this type of device has required a relatively elongated vertical neck portion to be formed in the glass receptacle leading to restrictions on the performance of the receptacle during pouring of liquid therefrom. Not only is the decanter, in practice, difficult to utilize in achieving complete dispensation of liquid therefrom but, rapid pouring of the liquid within the receptacle from the decanter tends to cause the liquid to separate from the pouring spout portion of the neck band and pour directly from the receptacle, rather than passing over the pour spout. The resultant turbulent flow of the liquid pouring from the decanter vessel tends to cause excessive splashing.

Attempts to overcome the shortcomings of the prior art devices have met with varying degrees of success. For example, the device shown in U.S. Pat. No. 3,615,045 to Fiorini is directed to an apparatus with a unitary pouring spout structure which is force fitted onto the neck of the glass receptacle with a gasket sandwiched therebetween. However, due to the nature of structure, assembly is difficult and can frequently lead to damage or breakage of the decanter during the assembly process. Furthermore, particularly tight tolerances are required between the components in order to provide for appropriate interfitting without affording such loose fit between the parts that leakage is induced. Also, since a tall neck portion is required in the glass receptacle, the same pouring difficulties inherent in the aforementioned Bloomfield device are experienced.

Wilbur Curtis Co., Inc., assignee of the instant patent application, has originated unitary pouring spout structures affixed to glass receptacles with an epoxy resin. While enjoying considerable success in the marketplace, such devices do have the shortcoming that assembly with the epoxy resins proposes some difficulty and contraction and expansion due to temperature changes, particularly sub-freezing temperatures upon shipping, may result in the differential co-efficient of thermal expansion leading to breakage. Also, some difficulties have been experienced because of poor adhesion with the polypropylene material normally utilized for forming the unitary pouring spouts.

Other efforts have led to the proposal of unitary pour spouts incorporating downwardly opening annular cavities to fit over the neck of a decanter flask and configured for receipt into such cavity of pourable molding material designed to effect a bonding lock over the neck itself. A device of this type is shown in U.S. Pat. No. 4,838,463 to Roberts. Such devices, while serving their intended purposes, suffer the shortcoming that the attachment process during assembly is somewhat messy and exhibits some degree of failure and rejection.

Other efforts have led to the proposal of unitary pour spouts to fit over the neck of a decanter and to sandwich therebetween a split threaded ring to cooperate with mating threads in the pour spout cavity in anticipation that threading of such pour spout on to such ring would contract the ring and trap the neck in position. Devices of this type are shown in U.S. Pat. No. 3,400,865 to Hester and U.S. Pat. No. 4,344,549 to Paradis. While serving their intended purposes, such devices suffer the shortcoming that screwing together of the components must be controlled with some degree of precision in order to provide a leak proof joint without applying excessive pressure to the decanter neck which may result in breakage thereof. Further, there exists the danger that, through use, and repetitive exposure to thermal cycles inherent in repeated washing and heating thereof, will partially unscrew the spout and free it for unwanted disassembly.

SUMMARY OF THE INVENTION

The present invention is characterized by a unitary pour spout formed with a downwardly extending annular skirt which is formed interiorly with a frusto conically shaped wall having formed thereon ratchet teeth. Received in the annular cavity between such skirt and the neck of the decanter is a contractible gripping ring which has formed in the exterior surface thereof ratchet teeth for mating with the first mentioned ratchet teeth. Consequently, by pressing the gripping ring upwardly into the skirt, the frusto conical shape thereof will press the skirt radially inwardly against the decanter neck to grip such neck and mating of the ratchet teeth will lock the gripping ring in position.

Other objects and features of the invention will become apparent from consideration of the following description taken in conjunction with the accompany drawing.

DESCRIPTION OF THE PREFERRED EMBODIMENT

Figure 1:
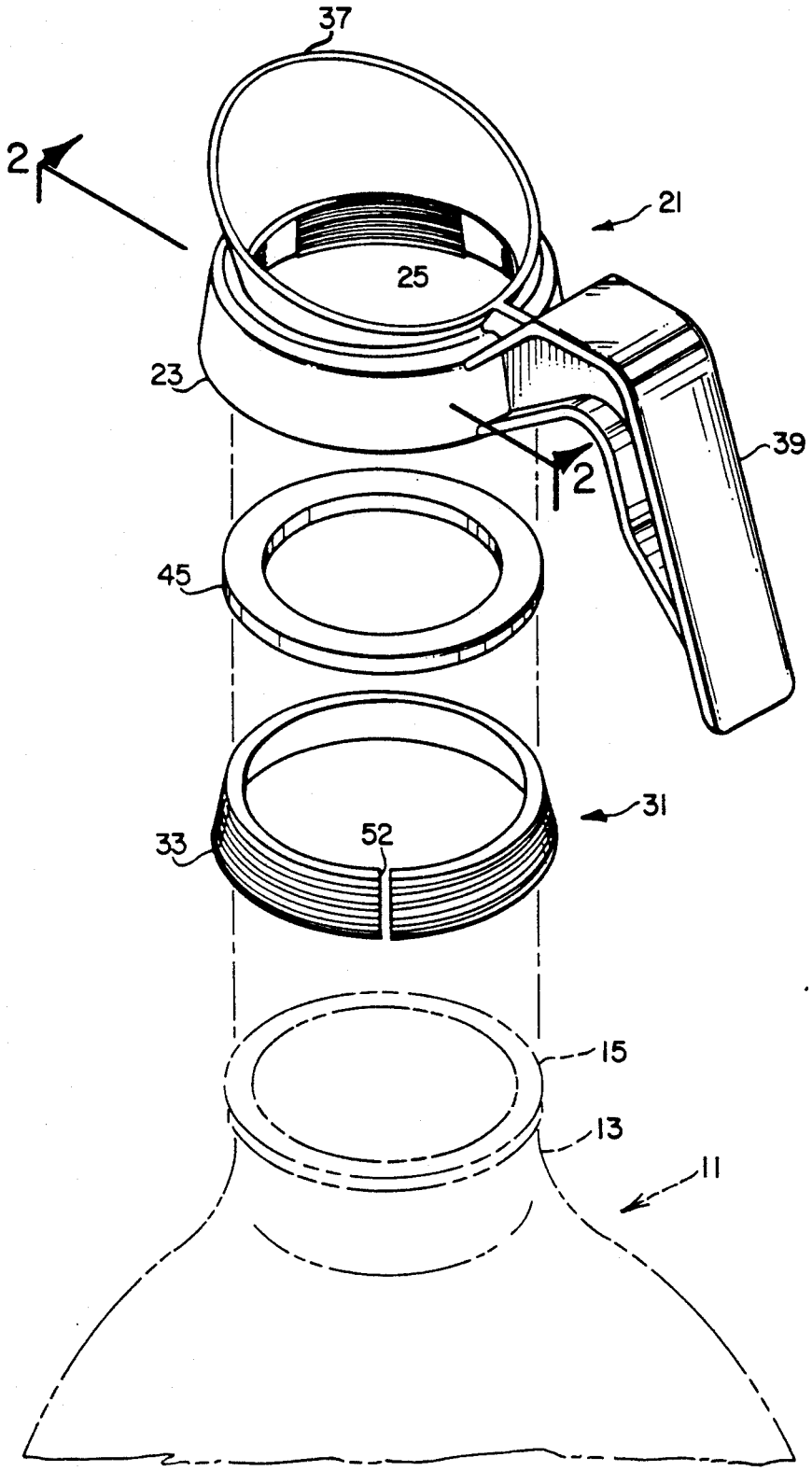
FIG. 1 is a partial perspective view of a decanter vessel embodying the present invention.

The decanter vessel of the present invention includes, generally, a decanter flask 11 formed with a unitary neck 13 projecting upwardly and terminating in a radial bead 15. A pour spout unit, generally designated 21, is formed with a downwardly depending annular skirt 23, generally frusto conically shaped to expand downwardly and outwardly and formed in its interior wall with ratchet threads 25. Received in the annular cavity 27 formed between the skirt 23 and neck 13 is a split lock ring, generally designated 31. Such lock ring is formed in its exterior with a frusto conical wall having ratchet teeth 33 formed thereon and configured to engage with and lock on the teeth 25 upon such ring being driven upwardly in the cavity 27 to lock such ring 31 in gripping relationship about the neck 13.

Conventionally, decanter flasks 11 are constructed of glass or glass-like material to thereby be impervious to attack by brewed coffee and to avoid tainting the flavor of such coffee. The flasks are typically formed with the upward projecting necks 13, such necks sometimes expanding upwardly and radially outwardly to terminate at the enlarged marginal beads 15.

The pour spout units 21 are typically constructed of food grade polypropylene and are formed on one side with a pouring spout 37 projecting in one direction and on the opposite side with an integral handle 39 projecting in the opposite direction. In the preferred embodiment, the pour spout unit 21 is formed with the downwardly and outwardly flared skirt 23 disposed concentrically about the neck 13 and cooperating therewith to form the annular cavity 27. Such cavity is formed on its top end with an annular groove defining a downwardly facing shoulder 43. The shoulder 43 is in the form of a downwardly facing somewhat concave recess to curve radially inwardly and downwardly to thus press the radially inward marginal edge of such gasket downwardly over the bead 13.

Preferably, a compressible annular gasket 45 is sandwiched between the top of the bead 15 and the downwardly facing annular shoulder 43.

The ratchet fourteen teeth 25 may be formed in the interior of the skirt at the time of molding and may be disposed in segmental sections spaced equidistant about the interior periphery of the skirt 23. In the preferred embodiment, the teeth 25 are about 0.031 inches long, are spaced to provide a linear distance between corresponding points on adjacent teeth (i.e. pitch) of about 0.035 inches. Such teeth are formed on the bottom side with annular surfaces 50 that angle upwardly and inwardly at an angle of about 37° to the horizontal. The top surfaces 52 are then configured with an upwardly facing horizontal annular surface.

Figure 2:
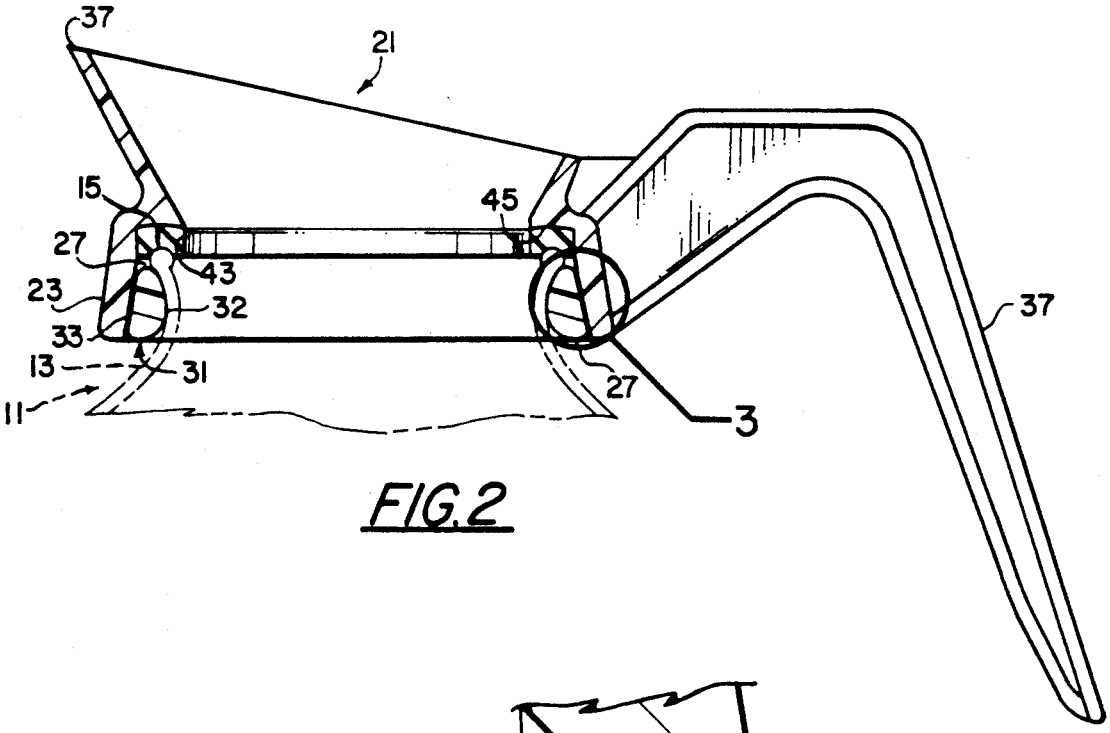
FIG. 2 is a sectional view, in enlarged scale, taken along the line 2—2 of FIG. 1.
Figure 3:
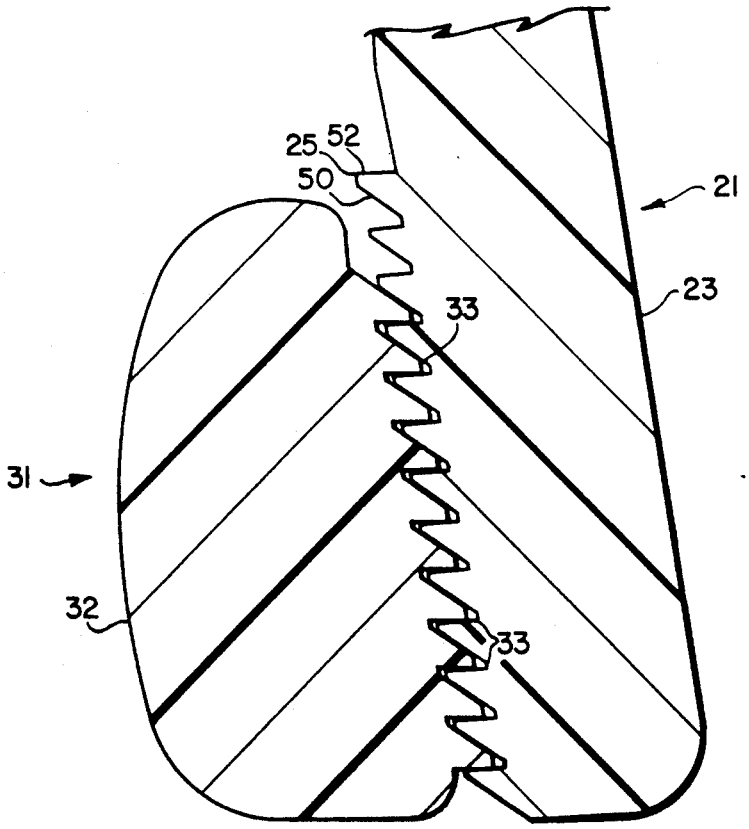
FIG. 3 is a detailed view, in enlarged scale, taken from the circle designated 3 in FIG. 2.

Referring to FIG. 1, the locking ring 31 may be constructed in any desirable form which will afford it a characteristic of being expandable to fit over the neck 13 but to be compressible radially inwardly by the skirt 23 upon being pressed upwardly into the annular cavity 27 (FIG. 2). In practice, the ring is frusto conical shaped on its exterior to complement the frusto conical shape of the cavity 27. The ring 31 is then formed on its interior with an inwardly facing vertically arcuate bearing surface 32 which is shaped to complement the vertical cross sectional shape of the neck 13. Such ring is formed on its exterior periphery with downwardly and outwardly angled ratchet teeth 33 shaped to complement the shape of the teeth 25 and to interlock therewith. The ring is split at 52 such that it may be conveniently expanded to fit over the neck 13 and may then be compressed radially inwardly by the skirt 23.

When the decanter vessel is to be assembled, it will be appreciated that the gasket 41 may be conveniently inserted within the skirt 23 to be nested against the downwardly facing shoulder 43. The locking ring 31 is then expanded and slipped over the neck 13 to be oriented with the small end of its frusto conical shape disposed upwardly. The gasket and pour spout unit 21 is then inserted over the neck 13.

The locking ring 31 is then pressed upwardly into the annular cavity 27 until the ratchet teeth sets 25 and 33 engage with one another. Continued upward pressing causes the locking ring 31 to be compressed radially inwardly against the neck 13 and, by concurrently pressing down on the pour spout 21, the sealing gasket 41 will be compressed slightly to thus achieve positive sealing between the shoulder 45 and bead 15. The sets of ratchet teeth will deflect slightly from their relaxed configuration to enable them to ratchet passed one another and lock with such ring 31 fully inserted within the skirt 23 to thus press the, somewhat curved in cross section, shoulder 45 downwardly on the gasket 43 to compressed and deflect such gasket to a somewhat crescent shape as viewed in cross section. This serves to establish a positive and reliable seal to prevent leakage between the spout unit and neck 13 of the decanter 11.

The decanter vessel may then be utilized in a customary fashion to store and pour brewed coffee. It will be appreciated that the decanter vessel incorporates relatively few components, is economical to manufacture and lends itself to assembly in a relatively full proof manner.

Various modifications and changes may be made with regard to the foregoing detailed description without departing from the spirit of the invention.

What is claimed is:

1. A decanter vessel comprising:

a rigid flask having an upwardly projecting neck terminating in a circular edge;

a pouring spout unit including an annular skirt for telescoping around the upper portion of said neck and an annular downwardly facing shoulder for overlying said edge, said skirt being formed with an interior wall of a generally frusto conical shape to angle downwardly and outwardly to form an upwardly tapered annular cavity between the neck and interior wall and being further formed on said wall with a first set of resilient ratchet teeth disposed about the periphery thereof and configured to angle upwardly and inwardly;

a locking ring formed to encircle said neck and be received in said cavity, said ring being compressible radially inwardly and being configured to, upon being driven upwardly into said cavity, be forced radially inwardly into gripping relation with said neck by the interior wall of said skirt, said ring being formed on its exterior with a second set of resilient ratchet teeth arranged to ratchet along said first set of teeth and to engage in locking relationship therewith;

whereby said ring may be installed in embracing relation on said neck and said pour spout unit positioned on said neck and said ring then slipped into said cavity to be pressed upwardly thereinto to compress said ring radially inwardly against said neck while engaging said sets of teeth in locking relationship to lock said ring in position engaged against said neck.

2. A decanter vessel according to claim 1 wherein:

said neck is formed with a bead defining said edge; and said ring is, upon engaging said wall and being flexed radially inwardly, engaged under said bead.

3. A decanter vessel according to claim 1 wherein:

said ring is split to provide for expansion and contraction thereof.

4. A decanter vessel according to claim 1 that includes:

an annular gasket interposed between said shoulder and said edge.

5. A decanter vessel according to claim 1 wherein:

said shoulder is formed with a downwardly facing annular recess for overlying said edge.

6. A decanter vessel according to claim 1 wherein:

said locking ring is formed in its exterior with a frusto conical shape to complement the shape of the interior wall of said skirt.

7. A decanter vessel according to claim 2 wherein:

said ring is split to provide for expansion and contraction thereof.

8. A decanter vessel according to claim 2 that includes:

an annular gasket interposed between said shoulder and said edge.

9. A decanter vessel according to claim 2 wherein:

said shoulder is formed with a downwardly facing annular recess for overlying said edge.

10. A decanter vessel according to claim 2 wherein:

said locking ring is formed in its exterior with a frusto conical shape to complement the shape of the interior wall of said skirt.

11. A decanter vessel according to claim 4 wherein:

said ring is split to provide for expansion and contraction thereof.

12. A decanter vessel according to claim 4 wherein:

said shoulder is formed with a downwardly facing annular recess for overlying said gasket.

13. A decanter vessel according to claim 4 wherein:

said locking ring is formed in its exterior with a frusto conical shape to complement the shape of the interior wall of said skirt.

* * * * *